US012742617B2

(12) United States Patent
Carman et al.

(10) Patent No.: US 12,742,617 B2
(45) Date of Patent: Sep. 22, 2026

(54) SUCTION DART TARGET GAME SYSTEM AND METHOD

(71) Applicant: PD Games, LLC, Coatesville, PA (US)

(72) Inventors: Joshua M. Carman, Coatesville, PA (US); Ryan W. Hoffman, Coatesville, PA (US); Jason R. Carman, Charleston, SC (US)

(73) Assignee: PD Games, LLC, Mount Pleasant, SC (US)

( * ) Notice: Subject to any disclaimer, the term of this patent is extended or adjusted under 35 U.S.C. 154(b) by 939 days.

(21) Appl. No.: 17/942,462

(22) Filed: Sep. 12, 2022

(65) Prior Publication Data

US 2023/0003492 A1 Jan. 5, 2023

Related U.S. Application Data

(63) Continuation-in-part of application No. 17/008,105, filed on Aug. 31, 2020, now abandoned.

(51) Int. Cl.

| | |
|---|---|
| ***F41J 3/00*** | (2006.01) |
| ***A63F 9/02*** | (2006.01) |
| ***F42B 6/08*** | (2006.01) |

(52) U.S. Cl.

CPC ..... *F41J 3/0038* (2013.01); *A63F 9/0208* (2013.01); *F42B 6/08* (2013.01)

(58) Field of Classification Search

CPC ..... F41J 3/0038; F41J 3/0033; F42B 6/003; A63F 9/0208

USPC ..... D21/407; 473/572; 273/348

See application file for complete search history.

(56) References Cited

U.S. PATENT DOCUMENTS 1,936,491 A * 11/1933 Weinberg ..... A63F 9/0208 473/572
3,014,724 A * 12/1961 Cryder ..... A63F 9/0208 273/358
3,424,460 A * 1/1969 Simpson ..... F41J 3/0038 473/578
4,305,587 A * 12/1981 O'Grady ..... A63F 9/0208 273/348.3

(Continued)

OTHER PUBLICATIONS

Squigz, Fat Brain Toys, www.fatbraintoys,com/toy_companies/fat_brain_toy_co/squigz.cfm,archived by the internet Archive on Jan. 28, 2019 (Year:2019).*

(Continued)

*Primary Examiner* — Dmitry Suhol

(74) *Attorney, Agent, or Firm* — Olav M. Underdal; IDP Patent Services

(57) ABSTRACT

A suction dart target game system includes a throwing member with a central protrusion, and first and second throwing suction cups; and a target piece with a first target suction cup; such that the target piece is attached to a mounting structure, such that a user can throw the throwing member at the target piece from a distance, optionally such that the throwing member rotates in flight, such that either the first throwing suction cup or the second throwing suction cup attaches to the first or second target suction cup or to a surface area of the mounting structure adjacent to the target piece, if a throw is successful. Also disclosed is a suction dart target game method, including positioning a target piece, throwing a throwing member, and measuring a distance.

20 Claims, 14 Drawing Sheets

(56) References Cited

U.S. PATENT DOCUMENTS

| | | | | | |
|---|---|---|---|---|---|
| 4,447,060 | A * | 5/1984 | Guinn | A63F 9/0208 | 473/573 |
| 5,362,066 | A * | 11/1994 | Sassak | A63B 67/197 | 473/573 |
| 5,603,503 | A * | 2/1997 | Lapidus | F41J 3/02 | 273/348.2 |
| D709,559 | S * | 7/2014 | Baumann | D21/407 | |
| D709,562 | S * | 7/2014 | Baumann | D21/407 | |
| D709,564 | S * | 7/2014 | Baumann | D21/407 | |
| D712,235 | S * | 9/2014 | Hoover | D8/349 | |
| D738,434 | S * | 9/2015 | Baumann | D21/407 | |
| 10,709,271 | B2 * | 7/2020 | Northrop | A47G 19/30 | |
| 2007/0074712 | A1 * | 4/2007 | Fielding | F41B 5/12 | 124/22 |
| 2012/0108138 | A1 * | 5/2012 | Walterscheid | A63H 3/50 | 446/268 |
| 2015/0321060 | A1 * | 11/2015 | Nuessle | A63B 67/02 | 273/317.2 |

OTHER PUBLICATIONS

A Mom's Take, "Reduce TV Time with 3 Exciting Activities", by Meagan, www.amomstake.com/reduce-tv-time-3-exciting-activities-giveaway/,last updated Dec. 18, 2014 (Year:2014).*

* cited by examiner

Suction Dart Target Game System

Suction Dart Target Game Method

SUCTION DART TARGET GAME SYSTEM AND METHOD

CROSS-REFERENCE TO RELATED APPLICATIONS

This U.S. Non-Provisional Application is a Continuation-In-Part of U.S. Non-Provisional application Ser. No. 17/008,105, filed Aug. 31, 2020; which is hereby incorporated herein by reference in its entirety.

FIELD OF THE INVENTION

The present invention relates generally to the field of recreational games, and more particularly to methods and systems for a suction dart and target system and method for a multi-player recreational game.

BACKGROUND OF THE INVENTION

Systems for throwing of darts at a target are well-known and in common usage for recreational gaming.

However, such conventional game systems generally utilize a piercing dart and a receiving target, wherein the piercing dart can be harmful by potentially piercing surfaces other that the receiving target and also the receiving target can be worn during use.

As such, considering the foregoing, it may be appreciated that there continues to be a need for novel and improved devices and methods for systems for the throwing of darts.

SUMMARY OF THE INVENTION

The foregoing needs are met, to a great extent, by the present invention, wherein in aspects of this invention, enhancements are provided to the existing model of a dart target game systems.

In an aspect, a suction dart target game system can include:

a) a throwing member, which can include:
   i. a throwing body; and
   ii. a first throwing suction cup, which can be mounted on a first end of the throwing body, such that an outer end of the first throwing suction cup faces away from the throwing body; and
   iii. a second throwing suction cup, which can be mounted on a second end of the throwing member, such that an outer end of the second throwing suction cup faces away from the throwing body; and b) a target piece, which can include:
   i. a target central body; and
   ii. a target suction cup, such that an outer end of the target suction cup is connected to an inner end of the target central body, such that an outer end of the target central body faces away from the target suction cup;

such that the target suction cup is configured to attach to the target piece securely and detachably to a mounting structure; and whereby the throwing member can be configured to enable a user to throw the throwing member at the target piece from a distance, optionally such that the throwing member rotates in flight, such that either the first throwing suction cup or the second throwing suction cup attaches to a surface area of the mounting structure adjacent to the target piece, if a throw is successful.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
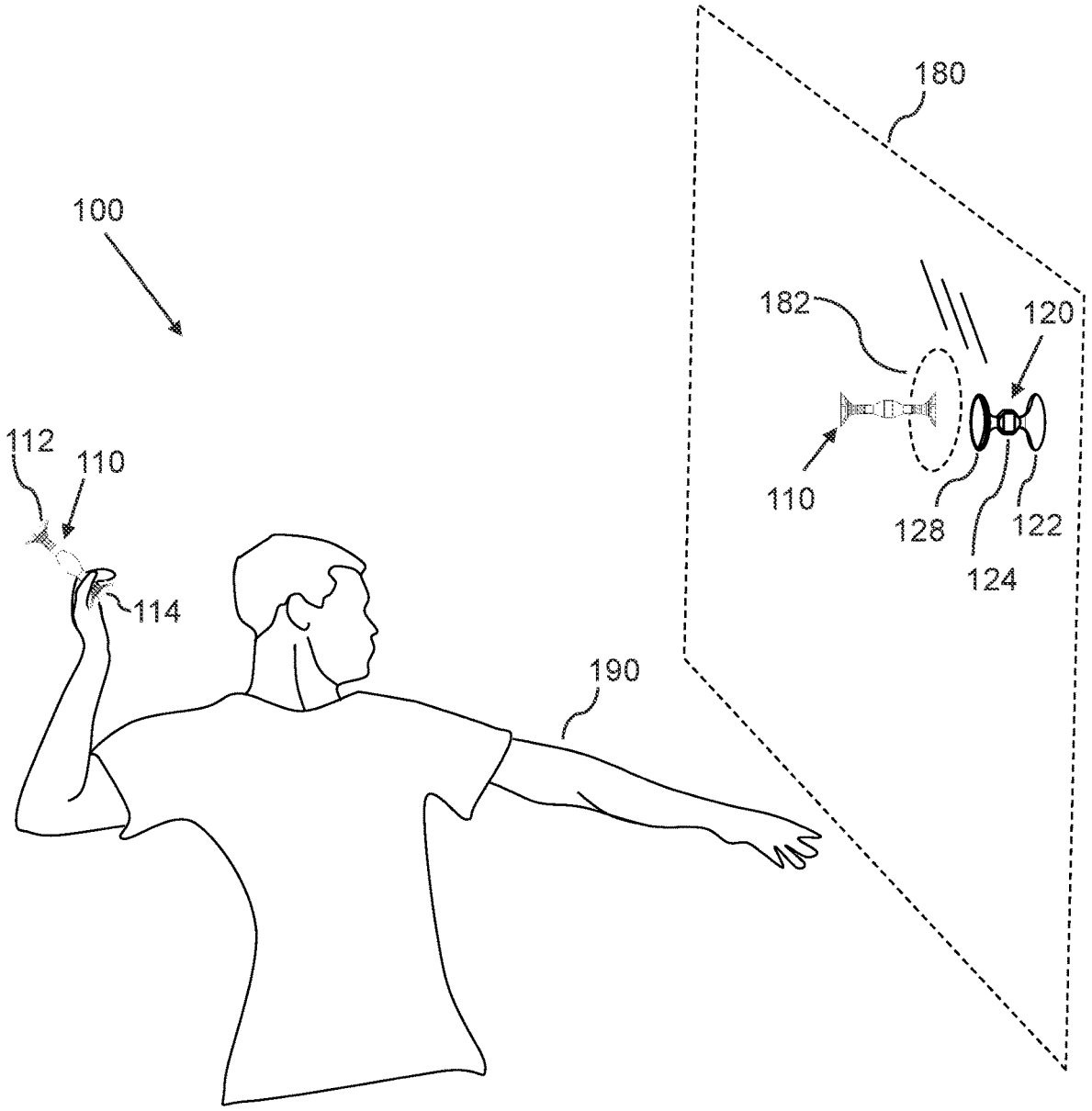
FIG. 1A is a perspective view of a suction dart target game system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a system for a suction dart target game system 100 with reference to FIG. 1A, in such manner that like reference numerals refer to like components throughout; a convention that we shall employ for the remainder of this specification.

Figure 2A:
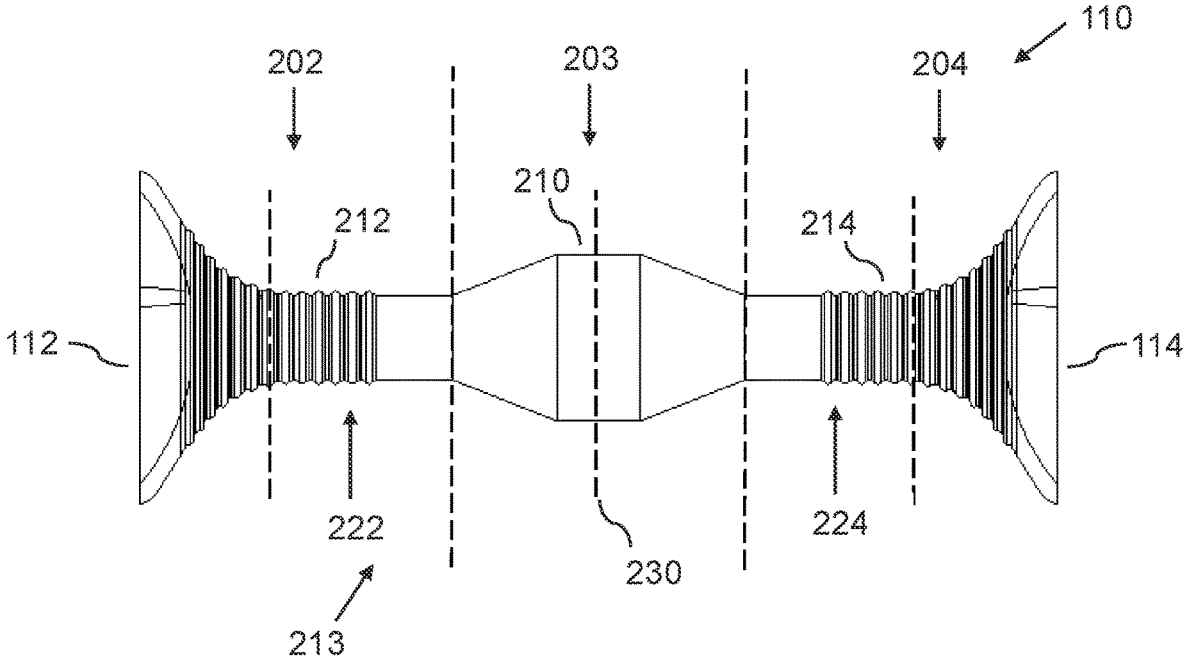
FIG. 2A is a top view of a throwing member of a suction dart target game system, according to an embodiment of the invention.
Figure 2B:
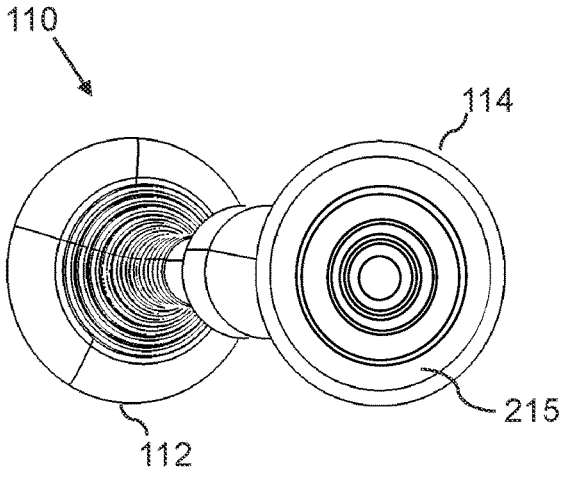
FIG. 2B is a top left view of a throwing member of a suction dart target game system, according to an embodiment of the invention.
Figure 2C:
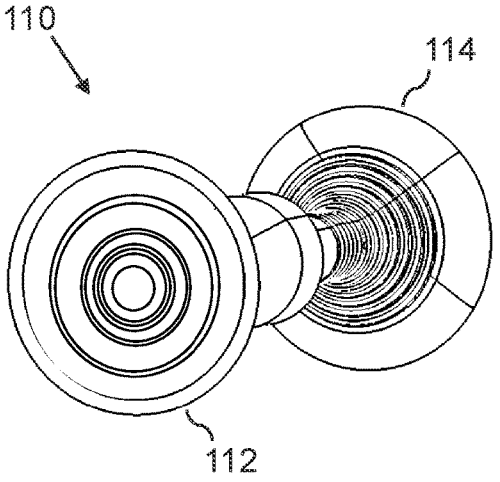
FIG. 2C is a top right view of a throwing member of a suction dart target game system, according to an embodiment of the invention.

In an embodiment, as shown in FIGS. 1A, 1B, 1C, 1D, 1E, 1F, and 2A, a suction dart target game system 100 can include:

a) at least one throwing member 110, as shown in FIG. 1A, which can include a plurality of throwing members 110, wherein each throwing member 110 can include:
   i. a throwing body 213, as shown in FIG. 2A; and
   ii. a first throwing suction cup 112, as shown in FIG. 1A, which can be mounted on a first end of the throwing body 213, such that an outer end of the first throwing suction cup 112 faces away from the throwing body 213; and
   iii. a second throwing suction cup 114, as shown in FIG. 1A, which can be mounted on a second end of the throwing member 110, such that an outer end of the second throwing suction cup faces away from the throwing body 213; and b) a target piece 120, 320, 420, 520, as shown in FIGS. 1A, 3A, 3B, 3C, 4A-4B, and 5A-5B, which can include:
   i. a target central body 124; and
   ii. a first target suction cup 122, such that an inner end of the first target suction cup 122 is connected to a first/inner end of the target central body 124, such that an second/outer end of the target central body faces away from the first target suction cup 122;

such that the first target suction cup 122 is configured to attach the target piece 120 securely and detachably to a mounting structure 180; and whereby the throwing member 110 can be configured to enable a user 190 to throw the throwing member 110 at the target piece 120 from a distance 170, optionally such that the throwing member 110 rotates in flight, as shown in FIGS. 1C, 1D, 1E, and 1F, and such that either the first throwing suction cup 112 or the second throwing suction cup 114 attaches to a surface area 182 of the mounting structure 180 adjacent to the target piece 120, if a throw is successful.

In a related embodiment, the throwing member 110 may be thrown without rotation, such that that the throwing member 110 flies in a straight trajectory, similar to a conventional dart throw in conventional darts. When throwing the throwing member 110 without rotation, the player 190 may adopt a conventional posture with the hand of the player 190 in a front of the player 190 when throwing the throwing member 110 and holding the throwing member 110 in a manner similar to a conventional hand position when throwing conventional darts.

In a related embodiment, as shown in FIGS. 4A-4B and 5A-5B, the target piece 420, 520 can include a target central body 424, 524 without a flat outer surface 326 (i.e., without a target landing surface 326), such that the target piece 420, 520 is used solely as a target marker/indicator to indicate proximity to the target marker; and In another related embodiment, the throwing member 110 can be configured to solely include two suction cups mounted on the first end of the throwing body 213 and the second end of the throwing body 213, respectively, i.e. on opposing ends of the throwing body 213; i.e., such that the at least one throwing member 110 does not include any suction cup other than the first throwing suction cup 112 and the second throwing suction cup 114.

Figure 3A:
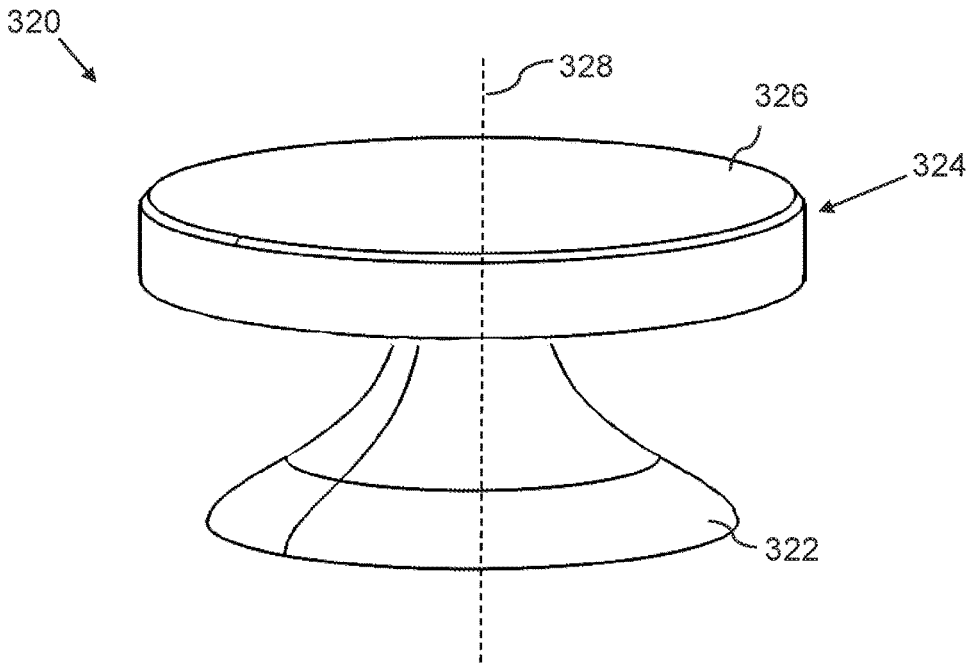
FIG. 3A is a perspective view of a target piece of a suction dart target game system, according to an embodiment of the invention.
Figure 3B:
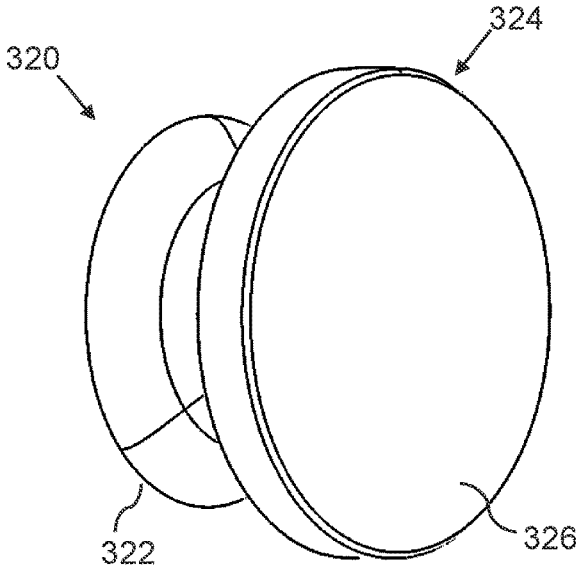
FIG. 3B is a top left view of a target piece of a suction dart target game system, according to an embodiment of the invention.
Figure 3C:
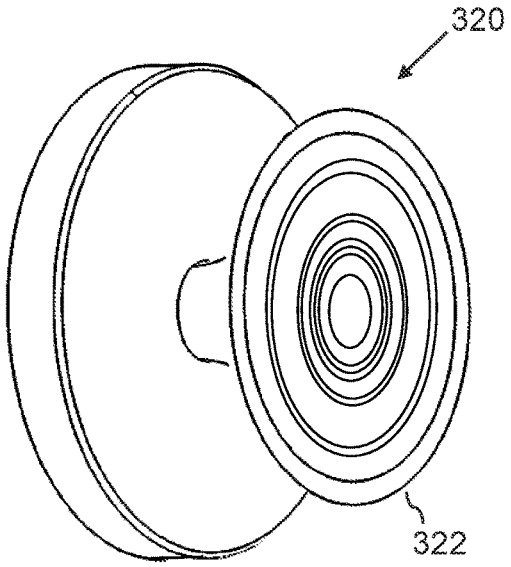
FIG. 3C is a top right view of a target piece of a suction dart target game system, according to an embodiment of the invention.

In yet another related embodiment, as shown in FIGS. 3A, 3B, and 3C, the target central body 324 can be a plate or disk, which can include a flat outer surface 326, which is perpendicular to an elongated axis 328 of the target piece 120. The disk-shaped target central body 324 can be circular as shown. In a related embodiment, the throwing member 110 can land on a top of the target piece 120, on the flat outer surface 326, such that the throwing member 110 suctions to the target piece 120, and thereby attaches to the target piece 120. A diameter (or in general a surface area size) of the outer surface 326 of the target central body 324 can be larger than a diameter/surface area size of an outer surface 215 of an attaching suction cup 112, 114 of the throwing member 110, such that the suction cup 112, 114 can be configured to attach to the flat outer surface 326, such that the throwing member 110 can be capable of landing on the target piece 120 when the target piece 120 is attached to the mounting structure 180.

Figure 4A:
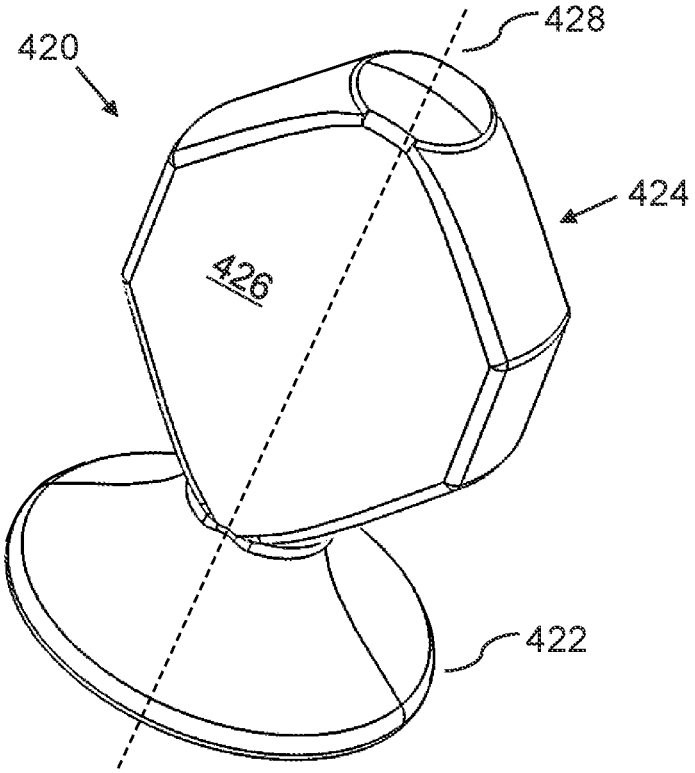
FIG. 4A is a front perspective view of a target piece of a suction dart target game system, according to an embodiment of the invention.
Figure 4B:
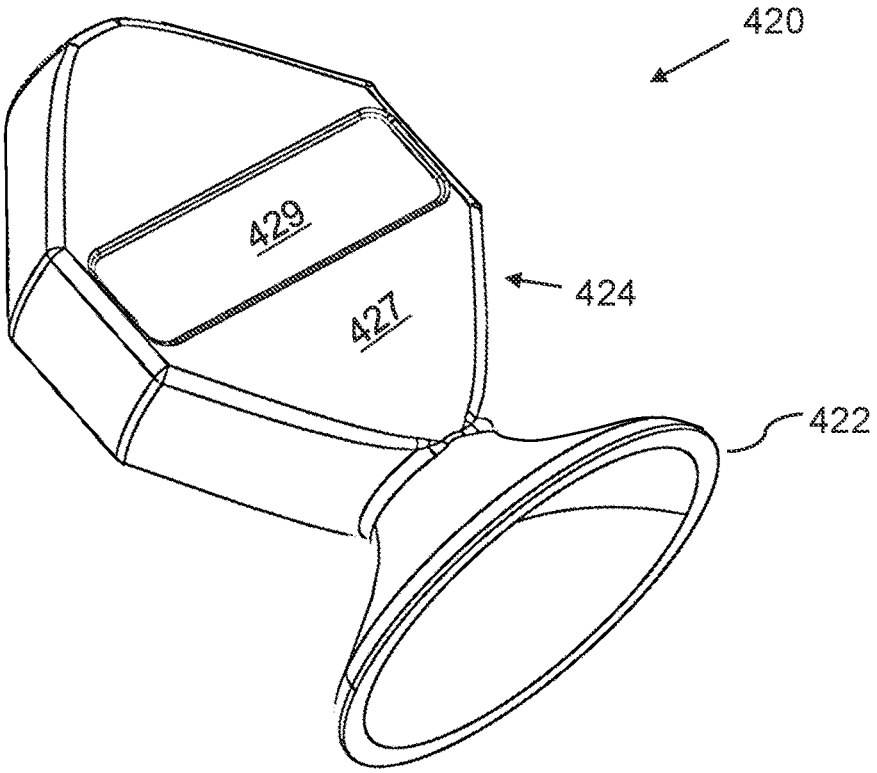
FIG. 4B is a rear perspective view of a target piece of a suction dart target game system, according to an embodiment of the invention.

In yet another related embodiment, as shown in FIGS. 4A and 4B, the target central body 424 can be a plate or disk, such that main opposing surfaces 426, 427 of the target central body 124 are parallel to an elongated axis 428 of the target piece 420. The plate-shaped target central body 424 can be rectangular, for example shaped as an elongated octagon, as shown. Optionally, at least one of the main opposing surfaces 426, 427 can further include a logo indentation 429 for depicting a logo, which for example can be embossed, engraved, or printed.

Figure 5A:
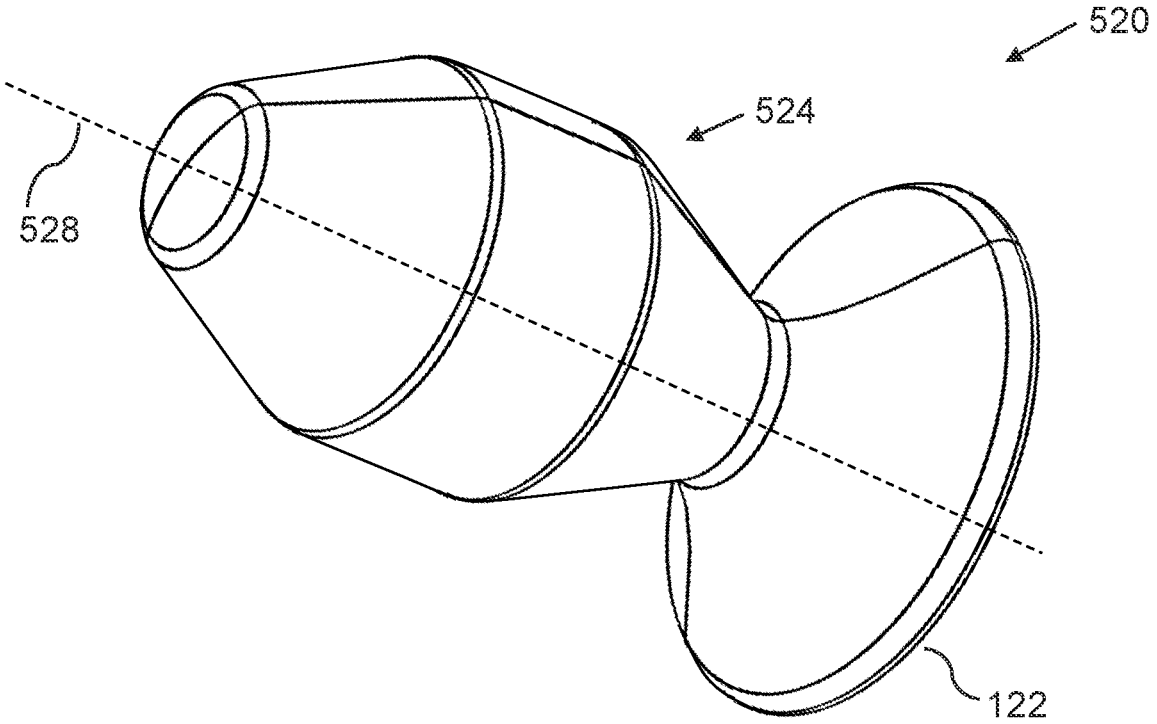
FIG. 5A is a front perspective view of a target piece of a suction dart target game system, according to an embodiment of the invention.
Figure 5B:
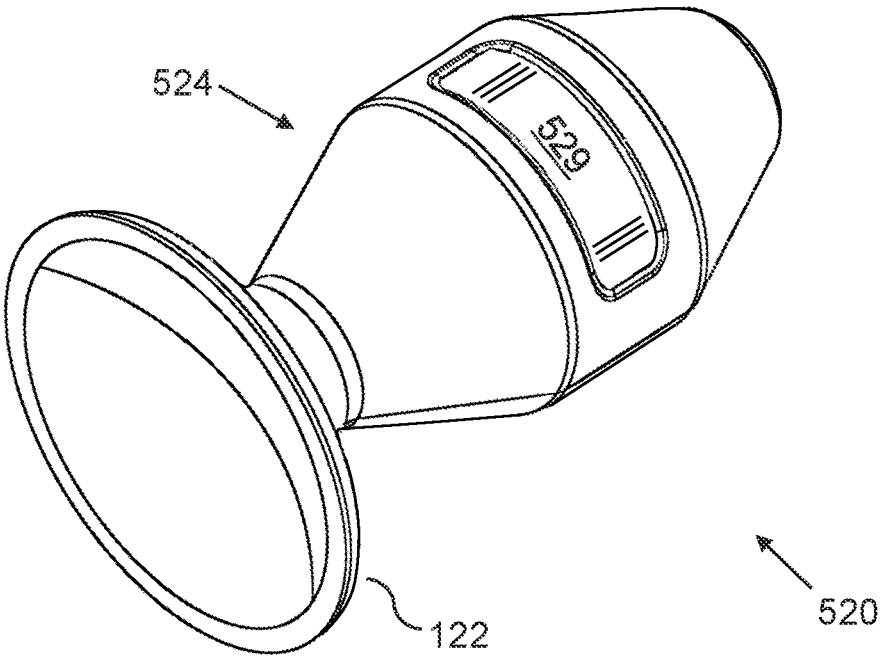
FIG. 5B is a rear perspective view of a target piece of a suction dart target game system, according to an embodiment of the invention.

In another related embodiment, as shown in FIGS. 5A and 5B, the target central body 524 can be elongated and rotationally symmetrical around an elongated axis 528 of the target piece 520. The elongated and rotationally symmetric target central body 524 can be substantially football-shaped, as shown. Optionally, the target central body 524 can further include a logo indentation 529 for depicting a logo, which for example can be embossed, engraved, or printed.

In various further related embodiments, the throwing member 110 and target suction cup 122, can facilitate use for a multitude of different applications, such that the throwing member 110 and target suction cup 122 can be configured to be able to stick and hold to any surface that is not porous.

In a related embodiment, as shown in FIG. 2A, the throwing body 213 can further include:

a) a first stem portion 222, such that an outer end of the first stem portion 222 is connected to an inner end of the first throwing suction cup 112;

b) a second stem portion 224, such that an outer end of the second stem portion 224 is connected to an inner end of the second throwing suction cup 114; and c) a central protrusion 210, which can be configured to protrude from a center portion of the throwing body 213, such that the central protrusion 210 is connected between inner ends of the first stem portion 222 and the second stem portion 224;

wherein the central protrusion 210 diameter can be 20-50% smaller in diameter than the first throwing suction cup 112 and the second throwing suction cup 114. When the throwing member 110 is molded in one piece, there can be a gradual transition from a suction cup 112, 114 to a corresponding stem portion 222, 224.

In various further related embodiments, the central protrusion 210 of the throwing member 110, along with the narrow stems extending outward, give the throwing piece a comfortable, natural feel in the user's hand when held and thrown. The additional mass of the central protrusion 210 is at the center of the throwing member 110, such that this additional mass gives the piece a central point of gravity when thrown end-over-end; and has very little effect on the rotational inertia of the throwing member 110. This means that, given a "standard throw", the throwing member 110 will spin at a similar rate as if the additional central mass were not present. Conversely, the additional mass added farther toward the ends of the stems at the suction cups (farther away from the central protrusion), this will significantly increase the throwing member's 110 rotational inertia. This will mean that the throwing member 110, given the same "standard throw", will spin at a significantly slower rate than that of a throwing member 110 with a smaller rotational inertia.

In another related embodiment, the stems 222, 224 can be configured with a length from the central protrusion 210 to the base of the suction cup, as well as a diameter of the stem, to allow the perfect balance of flexibility and rigidness. This gives the throwing member 110 an optimal capability to absorb impact; as well as be able to deform into a hit (suctioned) position.

In a related embodiment, as shown in FIG. 2A, the throwing member can further include:

a) a first handle portion 212, as shown in FIG. 2A, which can be positioned between an outer end of the first throwing suction cup 112 and a center 230 of the throwing body 213, or between an outer end of the first throwing suction cup 112 and the central protrusion 210; and wherein the first handle portion 212 can be configured to gradually narrow towards an inner end of the first handle portion 212;

whereby the inner end of the first handle portion 212 can be configured to connect with the central protrusion 210;

b) a second handle portion 214, as shown in FIG. 2A, which can be positioned between an outer end of the second throwing suction cup 114 and a center 230 of the throwing body 213, or between an outer end of the second throwing suction cup 114 and the central protrusion 210; and wherein the second handle portion 214 can be configured to gradually narrow towards an inner end of the second handle portion 214;

whereby the inner end of the second handle portion 214 can be configured to connect with the central protrusion 210;

wherein, as shown, the handle portions 212, 214 may overlap inner parts of the respective suction cups 112, 114 and outer parts of the respective stems 222, 224.

In another related embodiment, the first handle portion 212 and the second handle portion 214 can be configured with a ribbed surface texture, such that the ribbed surface texture provides an improved grip when holding, throwing or removing the throwing member 110.

In a related embodiment, as shown in FIG. 2A, the throwing member 110 can include:

a) a first outer portion 202, as shown in FIG. 2A, that can include the first throwing suction cup 112 and the first stem portion 222;

b) a second outer portion 204, as shown in FIG. 2A, that can include the second throwing suction cup 114 and the second stem portion 224;

c) a center portion 203, between the first outer portion 202 and the second outer portion 204, wherein the center portion 203 comprises the central protrusion 210;

wherein the first outer portion 202, the center portion 203 and the second outer portion 204 can each be configured to hold approximately one-third of the weight of the throwing member 110;

wherein the first outer portion 202 and the second outer portion 204 can each weigh approximately 7.3 grams;

and the center portion 203 can weigh approximately 9.3 grams;

such that the throwing member 110 can be configured to be able to be evenly end-over-end rotated.

In a further related embodiment, a weight of the center portion 203, i.e. a central weight of the central protrusion 210 can be in a range of 35%-43% of a total weight of the throwing member 110.

In a related embodiment, the throwing member 110 and the target piece 120 can each be molded from a resilient material, such as a synthetic or natural rubber material, including a soft silicone rubber. The throwing member 110 can be made from a soft resilient material, such that a suction cup 112 emits a "popping" sound when landing and sticking to a surface. The throwing member 110 and the target piece 120 can each be molded in one piece.

In a related embodiment, as shown in FIGS. 1A-1B and 6A-6G, the target piece 120 can include:

a) a target central body 124;

b) a first target suction cup 122, which includes:

i. a first suction portion 614, which includes a first landing surface 615, which can include:

1) a first concave outer surface 652; and 2) a first peripheral rim 654 (which can be flat as shown), which encircles the first concave outer surface 652;

ii. a first stem portion 616, such that an outer end of the first stem portion 616 is connected to an inner end of the first suction portion 614;

such that an inner end of the first stem portion 616 (and of the first target suction cup 122) is connected to a first end of the target central body 124, such that a second end of the target central body faces away from the first target suction cup 122;

such that the first target suction cup 122 is configured to detachably attach to the mounting structure 180, such that the target piece 120 is detachably and securely attached to the mounting structure 180 in a first orientation; and c) a second target suction cup 128, which includes:

i. a second suction portion 624, which includes a second landing surface 625, which can include:

1) a second concave outer surface 662; and 2) a second peripheral rim 664 (which can be flat as shown) which encircles the second concave outer surface 662;

ii. a second stem portion 626, such that an outer end of the second stem portion 626 is connected to an inner end of the second suction portion 624;

such that an inner end of the second stem portion 626 (and of the second target suction cup 122) is connected to a second end of the target central body 124, such that the first end of the target central body 124 faces away from the second target suction cup 122;

such that the second target suction cup 128 is configured to detachably attach to the mounting structure 180, such that the target piece 120 is detachably and securely attached to the mounting structure 180 in a second orientation;

whereby either the first throwing suction cup 112 or the second throwing suction cup 114 can attach to an exposed target landing area 625 of the second target suction cup 128 when the first target suction cup 122 is attached to the mounting structure 180.

In a related embodiment, outer diameters of each of the first suction portion 614 and the second suction portion 624 of the target piece 120 can be identical and can be 60 mm (i.e., about 2.3622. inches) or in a range of 40 to 80 mm (i.e., about 1.5748 to 3.1496 inches).

In a related embodiment, outer target diameters of each of the first suction portion 614 and the second suction portion 624 of the target piece 120 can be at least 50% larger than the outer throwing diameters of each of the first throwing suction cup 112 and the second throwing suction cup 114 of the throwing member 110, which can be 40 mm (i.e., about 1.5748 inches) or in a range of 30-50 mm (i.e. about 1.1811 to 3. 1.9685 inches). This gives an advanced player the chance at being able to land on top of an exposed landing surface 615, 625 for a bullseye; but also makes it very challenging for a beginner player. A size of outer target diameters of each of the first landing surface 615 and the second landing surface 625 of the target piece 120 can thereby be chosen to be larger than the outer throwing diameters of the throwing pieces, but not too large so as to get in the way of the rest of the playing surface.

Figure 6A:
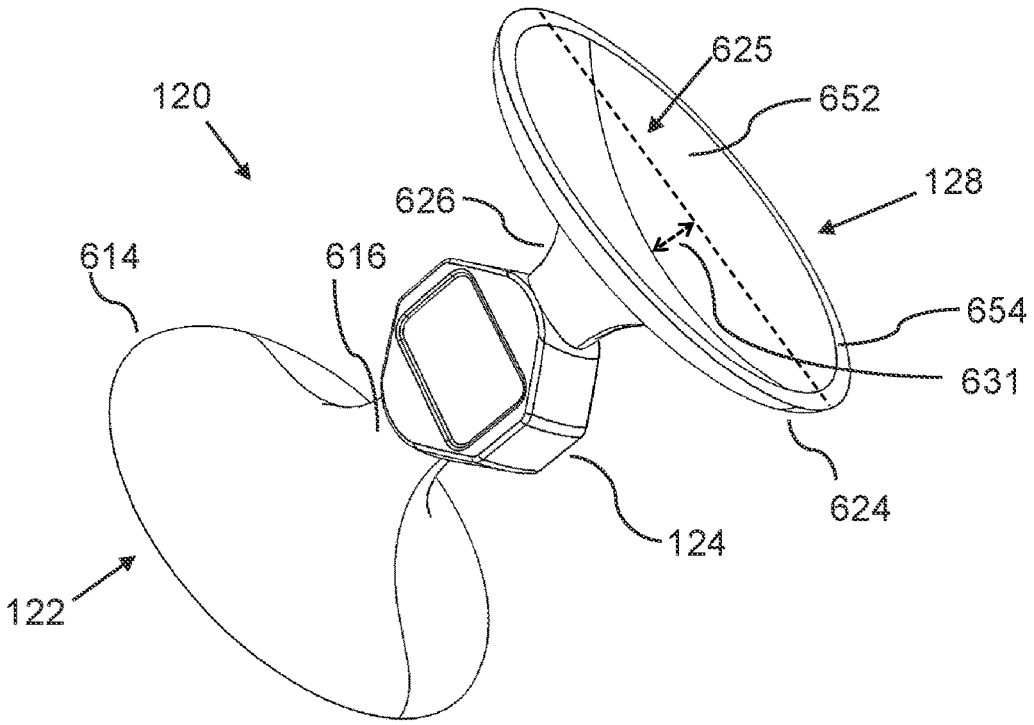
FIG. 6A is a front perspective view of a target piece of a suction dart target game system, according to an embodiment of the invention.
Figure 6B:
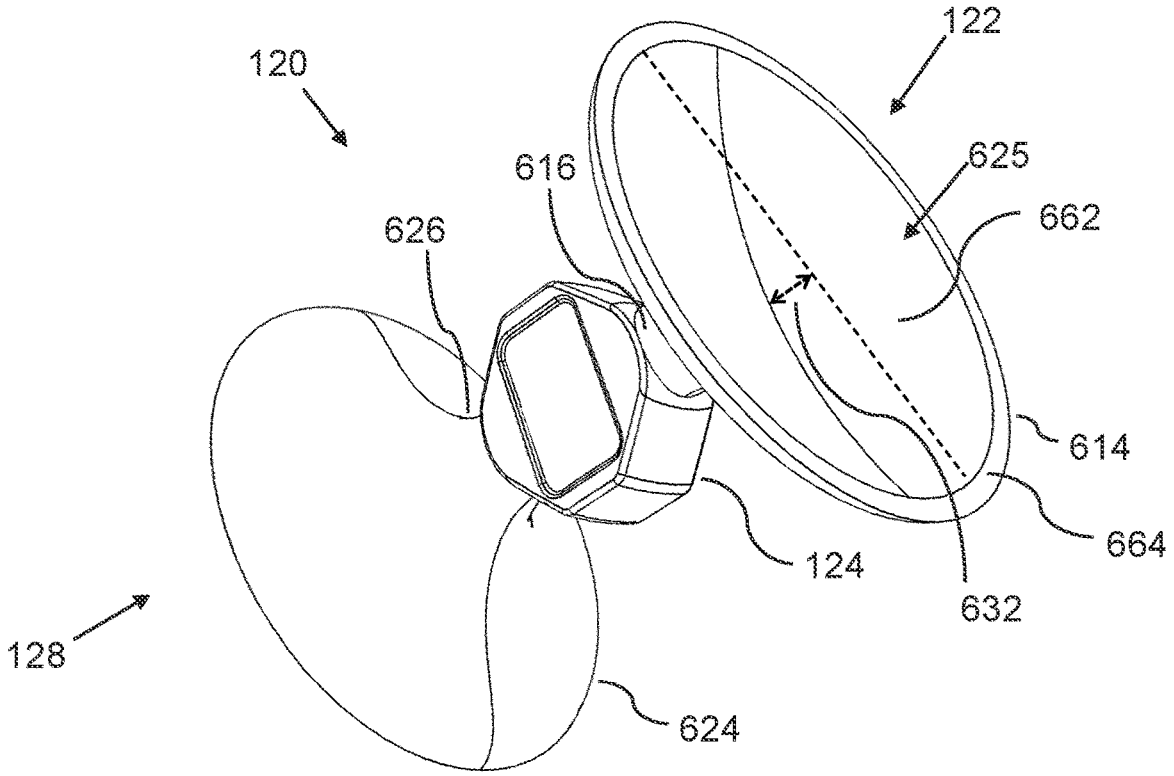
FIG. 6B is a rear perspective view of a target piece of a suction dart target game system, according to an embodiment of the invention.
Figure 6C:
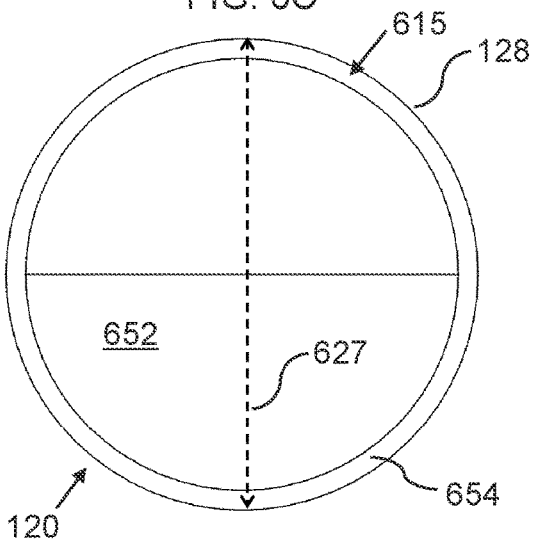
FIG. 6C is a front view of a target piece of a suction dart target game system, according to an embodiment of the invention.
Figure 6D:
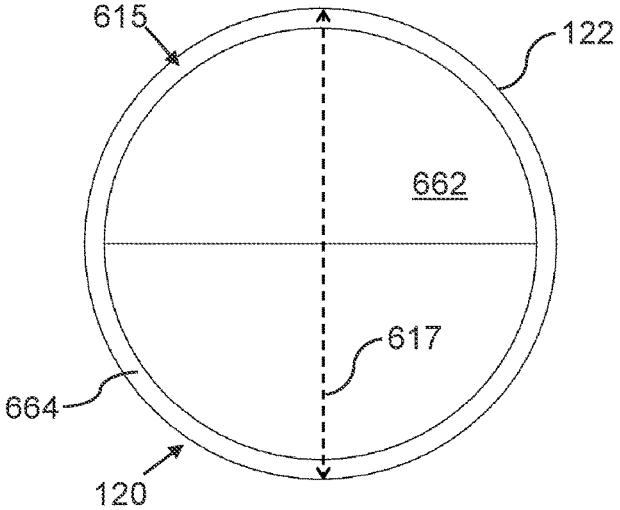
FIG. 6D is a rear view of a target piece of a suction dart target game system, according to an embodiment of the invention.
Figure 6E:
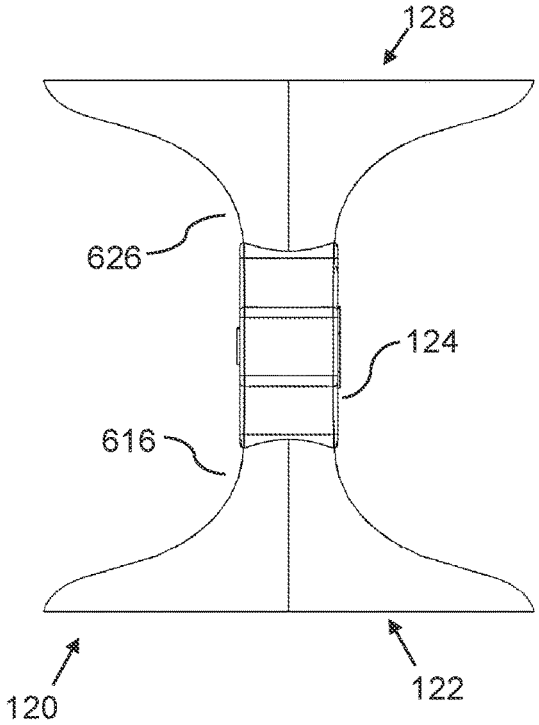
FIG. 6E is a top view of a target piece of a suction dart target game system, according to an embodiment of the invention.
Figure 6F:
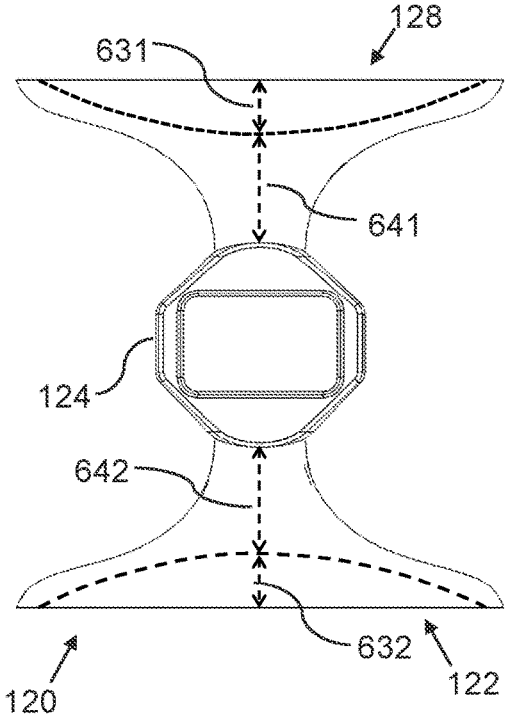
FIG. 6F is a right side view of a target piece of a suction dart target game system, according to an embodiment of the invention.
Figure 6G:
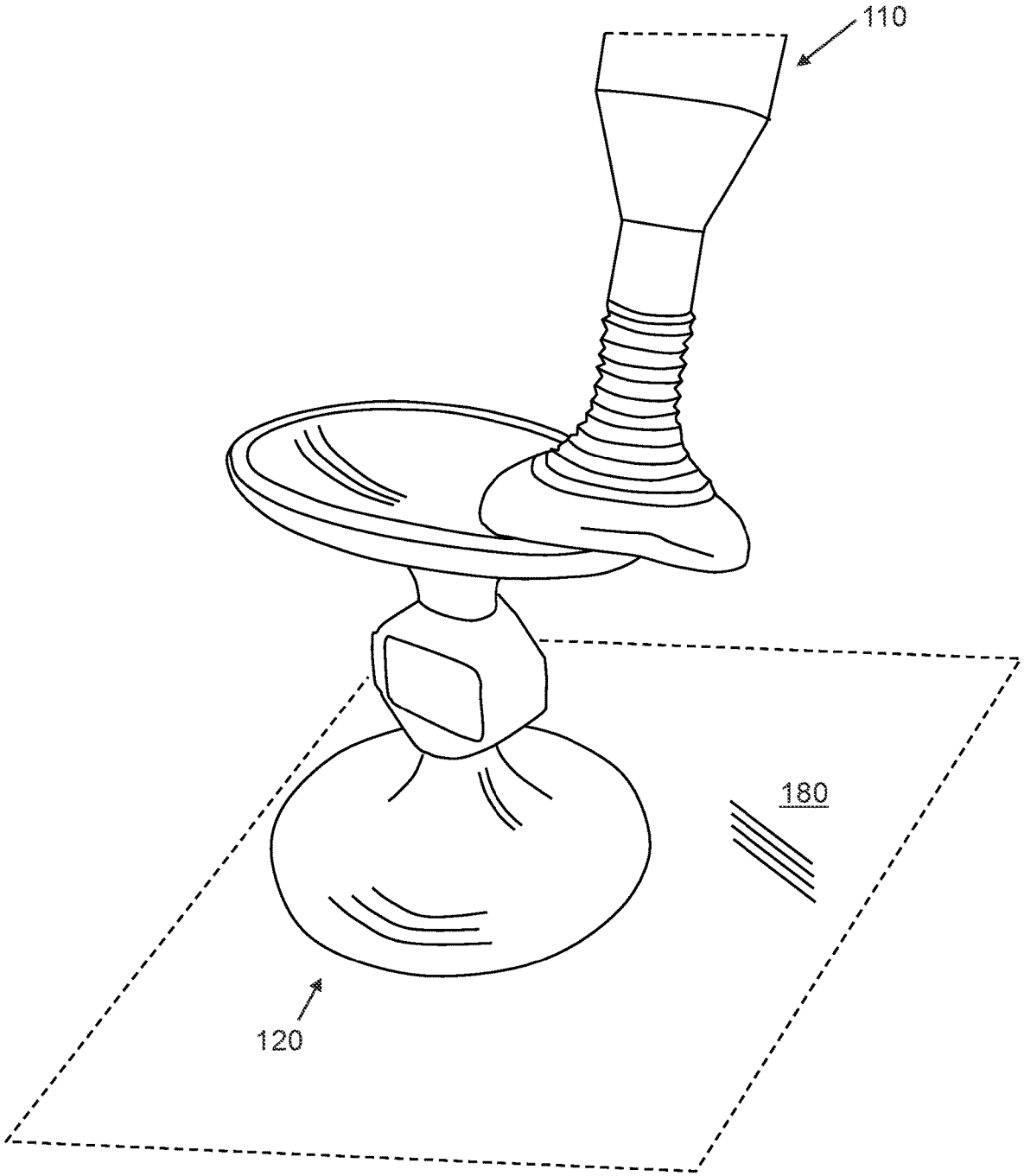
FIG. 6G is a perspective view of a target piece with a throwing member partially attached to a receiving suction cup of the target piece, according to an embodiment of the invention.
Figure 6H:
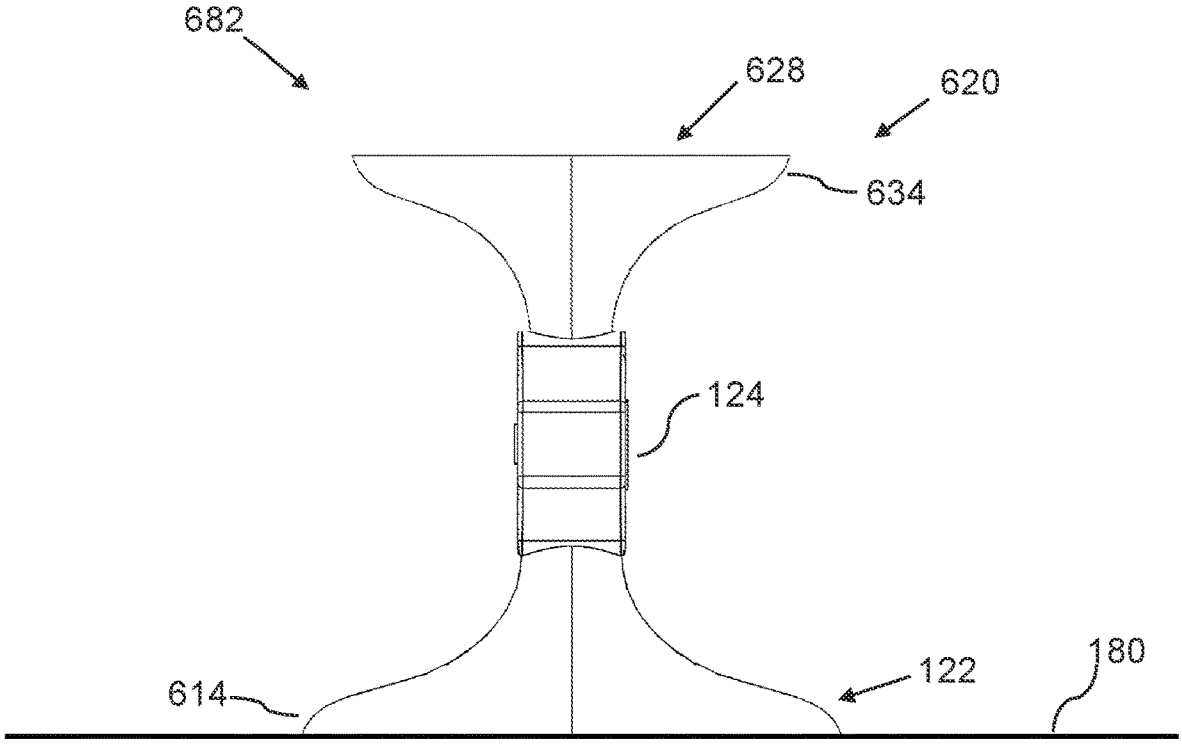
FIG. 6H is a top view of an asymmetrical target piece configured in a first orientation on a mounting surface, according to an embodiment of the invention.
Figure 6I:
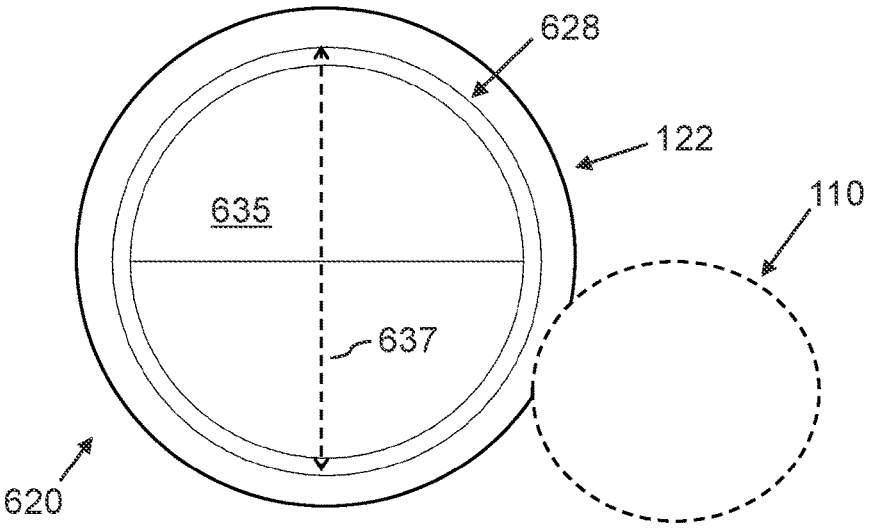
FIG. 6I is a front view of an asymmetrical target piece of a suction dart target game system, according to an embodiment of the invention.
Figure 6J:
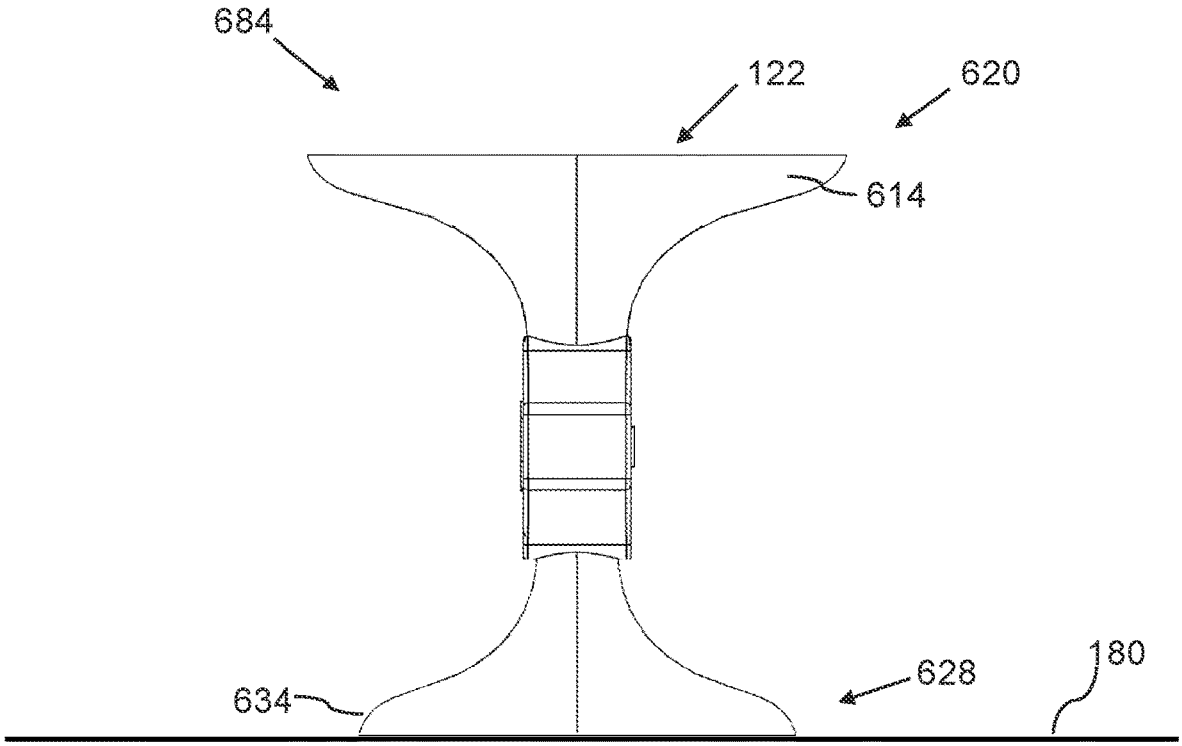
FIG. 6J is a top view of an asymmetrical target piece configured in a second orientation on a mounting surface, according to an embodiment of the invention.

In another related embodiment, an asymmetrical target piece 620, as shown in FIGS. 6H and 6I, can be configured such that outer diameters 617, 627 of each of the first suction portion 614 and the second suction portion 624 can each be in a range of 40 to 80 mm; wherein a first outer diameter 617 of the first suction portion 614 is at least 20% larger than a second outer diameter 637 of the second suction portion 634 (of the second target suction cup 628), whereby the target piece 120 is positionable on the mounting structure in a first orientation 682 (as shown in FIG. 6H) for advanced players 190 with a smaller exposed landing surface 635 (the second landing surface 635) of the second suction portion 624 when the first suction portion 614 is attached to the mounting structure 180; and in a second orientation 684 (as shown in FIG. 6J) for beginner players 190 with a larger exposed landing surface 615 (the first landing surface 615) of the second suction portion 624 when the second suction portion 624 is attached to the mounting structure 180. Note that due to the symmetrical design of the target piece 120, there is no visible or functional difference when the target piece 120 is positioned in either the first or second orientation.

In a related embodiment, each of the first concave outer surface 652 and the second concave outer surface 662 of the target piece 120 can be configured with a corresponding center depth 631, 632 of at least 6 mm (i.e., about 0.2362 inches) or in a range of 6-12 mm (i.e., about 0.2362-0.4724 inches), whereby the corresponding center depth 631, 632 is deep enough to allow air to be trapped between the throwing pieces suction cup and the receiving target markers suction cup, which thereby can increase the overall resulting landing surface to be outside the physical diameter, because the receiving target piece can hold a throwing piece that is only partially on the target marker and partially off therefore making the resulting landing surface approximately 100 mm in diameter (i.e., about 3.9370 inches), as up to half of the throwing member 110 can overhang, as shown in FIG. 6G.

In another related embodiment, each of the first target suction cup 122 and the second target suction cup 122 can be made from a resilient material, such as a natural or synthetic rubber material (which can be a silicone rubber/gel), which is configured with a Shore durometer type A hardness of 55, or in a range of 53-57, 52-58, 50-60, or a wider range; as measured by the Shore durometer type A hardness scale, which is a dimensionless scale in accordance with the ASTM D2240 Type A specification; such that the specified hardness create optimal stickability and make the receiving suction cup not too firm as to reject the throwing piece by bouncing off; but rather the outer lips are pliable and flexible enough to absorb an impact and receive the throwing piece. Note that when landing the throwing member 110 on a receiving target suction cup 122, 128, the throwing member 110 may typically slide downward 3-5 mm (i.e., about 0.1181-0.1969 inches) before settling in position and the predetermined hardness in the specified range will ensure that the throwing member 110 reliably settles in position.

In yet a related embodiment, stem lengths 641, 642 of corresponding stem portions 616, 626 from corresponding ends of the target central body 124 to center points of corresponding concave outer surfaces 652, 662 of the of the target piece 120 can each be at least 10 mm (i.e., about 0.3937 inches), or in a range of 10-20 mm (i.e., about 0.3937-0.7874 inches), 10-30 mm (i.e., about 0.3937-1.1811 inches), or more, such that the stem portions 616, 626 are able to bend upon an impact of the throwing piece 110, to absorb the impact, and increase the likelihood of sticking better than if it were to hit a hard surface and be rejected or bounce off.

In an embodiment, rules for playing the suction dart target game by using the suction dart target game system 100, can include:

a) The game is played with six suction darts 110 (also called throwing members 110) and one target piece 120. There are three suction darts 110 per team and they are made of a different color to distinguish between teams. The game is played with two opponents, with each player (team) having three suction darts 110;

b) A game begins with the toss of a coin. The team that wins the coin toss can choose to either have first target placement or choice of suction dart 110 color. To start a game, the target piece 120 is placed by the player determined at the coin toss. A player can put the target piece 120 on any vertical or horizontal surface that it can be suctioned to and at any distance;

c) The player placing the target piece 120 can give custom parameters for that one round. The player can make the parameters as easy or as difficult as they choose. Parameters can include, but are not limited to the following:

i. The type of throw: Underhand, overhand, side arm, behind the back;

ii. Distance: 6 feet, 10 feet, etc. or may use terms like, "Behind here"

d) Once the parameters are set, the player that placed the target piece 120 throws the first suction dart 110. The players optionally rotate throwing their suction darts 110 to get closest to the target piece 120. This continues until both players have thrown all their suction darts 110. After both players have exhausted all their suction darts 110, the round is over and points are awarded;

e) Any suction dart 110 that does not suction to the surface is considered a dead dart and is left in play until the end of a round;

f) At the end of each round, points will be awarded. Only one player scores in a round;

g) One point is awarded for each suction dart 110 that is closer to the target piece 120 than the closest suction dart 110 of the opposing player;

h) If one of the closest player's suction darts 110 are touching the target piece 120, the suction dart 110 will count as 2 points;

i) If the suction dart 110 lands on top of and suctions to the target piece 120, the player is awarded 3 points and automatically wins that round;

j) If a second suction dart 110 of a second player 190 lands on top of an already landed first suction dart 110 of a first player 190, the second player is awarded double points relative to the original points earned by the first player for the already landed first suction dart 110;

k) The player that was awarded points in the previous round begins the next round by selecting the next target piece 120 location;

l) In the event that the closest suction dart 110 of each player is the same distance from the target piece 120, no points will be awarded and the target piece returns to the player that delivered it. All measurements should be made from the close edge of the suction dart to the close edge of a target piece;

m) Games are played to 12 points, with the first team reaching 12 points being the winner of a game.

Figure 7:
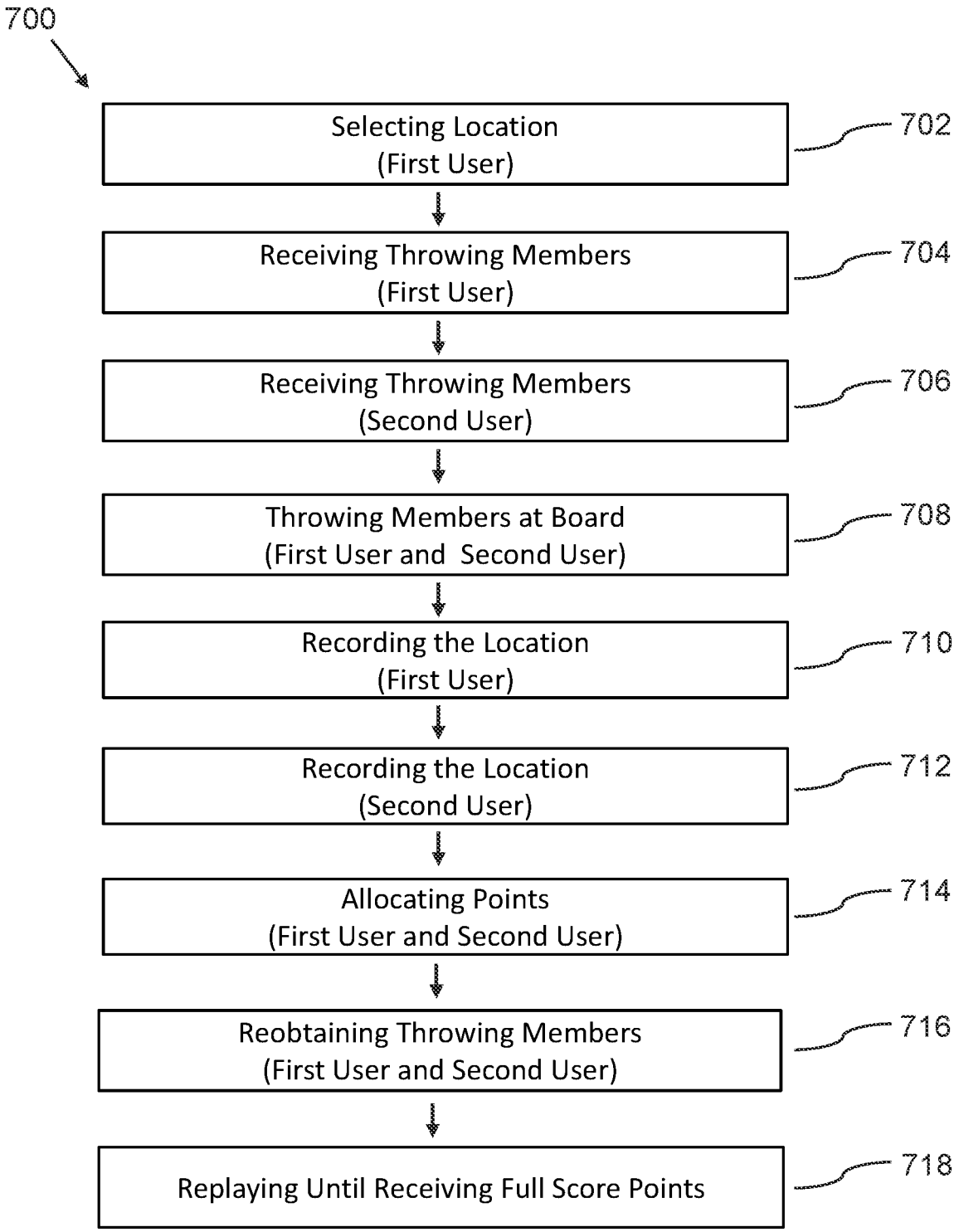
FIG. 7 is a flowchart illustrating steps that may be followed, in accordance with one embodiment of a suction dart target game method or process.

In an embodiment, as illustrated in FIG. 7, a method for a suction dart target game 700, can include:

a) Selecting location 702, wherein the user 190 attaches the target piece to a mounting structure 180;

b) Receiving throwing members 704, wherein the first user 190 receives a plurality of throwing members 110;

c) A second user 190 receiving throwing members 706, wherein the second user 190 receives a plurality of throwing members 110;

d) Throwing members at board 708, wherein the first user 190 and the second user 190 throw all of their plurality of the throwing member 110 at the target piece 120;

e) The user 190 recording the location 710, wherein the first user 190 can record the distance of their plurality of the throwing member 110 from the target piece 120;

f) The second user 190 recording the location 712, wherein the second user 190 can record the distance of their plurality of the throwing member 110 from the target piece 120;

g) Allocating points 714, wherein the first user 190 and second user 190 can allocate points based on the distance of the throwing member to the target piece 120;

such that the first user 190 or the second user 190 with the throwing member(s) 110 with the closest distance of the throwing member(s) 110 to the target piece 120 receives a point;

whereby in a case that the first user 190 or the second user 190 with the throwing member 110 with the closest distance of the throwing member 110 to the target piece 120 has the throwing member 110 touching the target piece 120, an additional point will be awarded;

whereby in a secondary case that the first user 190 or the second user 190 with the throwing member 110 with the closest distance of the throwing member 110 to the target piece 120 has the throwing member 110 landing atop of and suctioning to the target piece 120, a total of three points will be awarded;

such that for every round, only the first user 190 or the second user 190 can obtain points; and h) Reobtaining throwing members 716, wherein the first user 190 and the second user 190 can reobtain their thrown plurality of throwing member(s);

i) Replaying until receiving full score points 718, wherein a full score can be twelve points, wherein the first user 190 and the second user 190 can rethrow their respective plurality of the throwing member 110 at the target wherein either the first user 190 or the second user 190, respectively, wins the game, wherein the game can be concluded.

Figure 8:
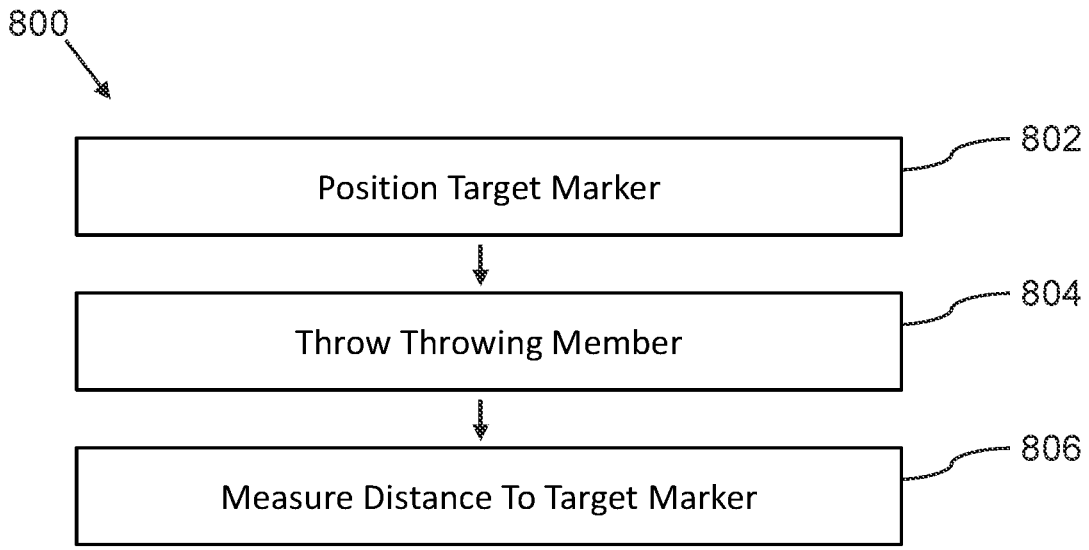
FIG. 8 is a flowchart illustrating steps that may be followed, in accordance with one embodiment of a suction dart target game method or process.

In a further related embodiment of the method for a method for a suction dart target game 700, six of the throwing members 110 for use in the method for a suction dart target game 700 can be configured such that three out of the six of the throwing member 110 can be made of a designated color and the remaining three of the six of the throwing member 110 can be made of a different designated color; such that the first user 190 and the second user 190 can differentiate ownership of the throwing member 110;

In an embodiment, as illustrated in FIG. 8, a method for a suction dart target game 800, can include:

a) positioning 802 a target piece 120, 620, wherein a user attaches the target piece 120, 620 to a mounting structure 180;

b) throwing 804 a throwing member 110, wherein the user throws the throwing member 110 towards the target piece 120, 620 from a throwing distance 170, optionally such that the throwing member 110 rotates in flight, and such that either a first throwing suction cup 112 or a second throwing suction cup 114 of the throwing member 110 attaches to either an exposed target landing surface 615, 625, 635 of the target piece 120, 620 (i.e. to an outer end of either the first or the second target suction cup 122, 128) or a surface area 182 of the mounting structure adjacent to the target piece 120, 620; and c) measuring 806 a target distance 160 from the throwing member 110 to the target piece 120, 620, when the throwing member 110 is attached to the portion of the mounting structure adjacent to the target piece;

such that the target distance 160 is set to zero when the throwing member 110 is attached to the exposed target landing surface.

In a related embodiment of the suction dart target game method, the target piece can be positioned on a vertical surface of the mounting structure, as shown in FIG. 1A.

Figure 1B:
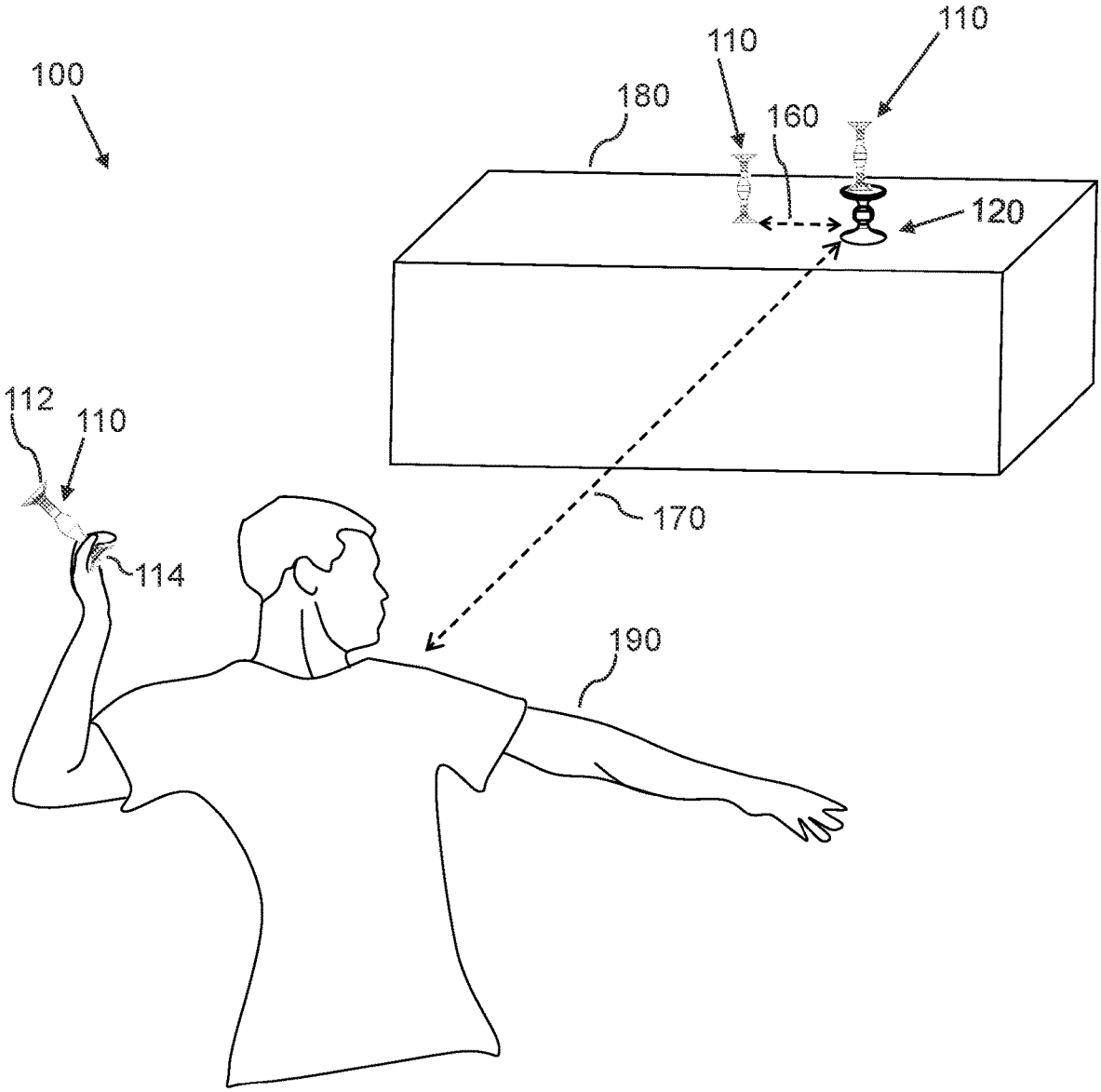
FIG. 1B is a perspective view of a suction dart target game system, with an alternate location of a target piece, according to an embodiment of the invention.
Figure 1C:
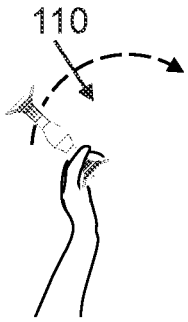
FIG. 1C is a perspective view of a suction dart target game system, illustrating the rotational movement of a throwing member, according to an embodiment of the invention.
Figure 1D:
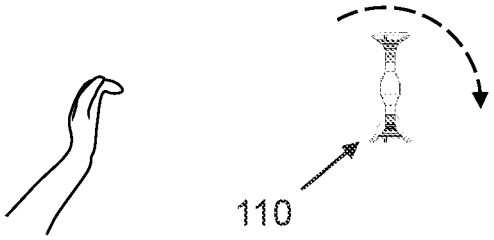
FIG. 1D is a perspective view of a suction dart target game system, illustrating the rotational movement of a throwing member, according to an embodiment of the invention.
Figure 1E:
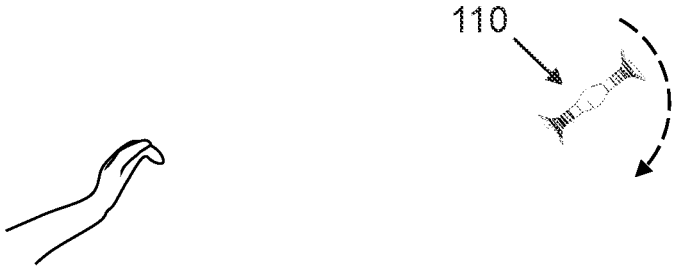
FIG. 1E is a perspective view of a suction dart target game system, illustrating the rotational movement of a throwing member, according to an embodiment of the invention.
Figure 1F:
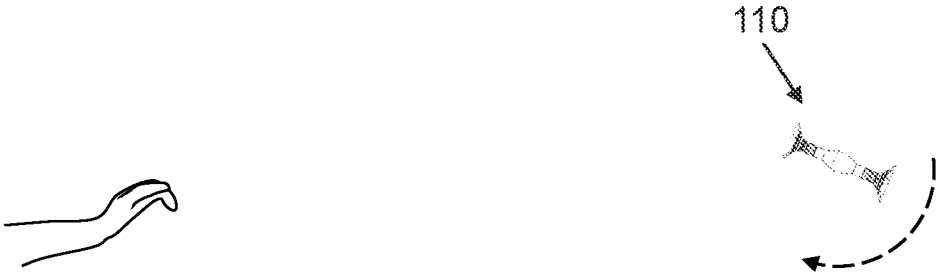
FIG. 1F is a perspective view of a suction dart target game system, illustrating the rotational movement of a throwing member, according to an embodiment of the invention.

In another related embodiment of the suction dart target game method, the target piece can be positioned on a horizontal surface of the mounting structure, as shown in FIG. 1B.

In an embodiment, the throwing member 110 can be thrown at the target piece 120, wherein the target piece 120 can be positioned vertically or horizontally, the throwing member 110 can include the central protrusion 210 to allow for even end-over-end rotation, the first handle portion 212 and second handle portion 214, can be just long enough to allow flexibility upon impact, wherein the first handle portion 212 and second handle portion 214 start to widen near the opposing ends displacing the weight farther from the central protrusion 210 to allow the throwing member 110 to have a slower and more controlled rotation through the air, wherein the first throwing suction cup 112 and the second throwing suction cup 114 are designed to be able to stick and hold to any flat (horizontal and vertical) surface that is not porous.

Here has thus been described a multitude of embodiments of the suction dart target game system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A suction dart target game system, comprising:

a) at least one throwing member, comprising:

a throwing body;

a first throwing suction cup, which is mounted on a first end of the throwing body, such that an outer end of the first throwing suction cup faces away from the throwing body; and a second throwing suction cup, which is mounted on a second end of the throwing body, such that an outer end of the second throwing suction cup faces away from the throwing body; and b) a target piece, comprising:

a target central body; and a first target suction cup, such that an inner end of the first target suction cup is connected to a first end of the target central body, such that a second end of the target central body faces away from the first target suction cup, wherein the first target suction cup further comprises:

a first suction portion, which comprises a first landing surface, which comprises a first concave outer surface; and a first stem portion, such that an outer end of the first stem portion is connected to an inner end of the first suction portion;

such that an inner end of the first stem portion is connected to a first end of the target central body, such that a second end of the target central body faces away from the first target suction cup;

a second target suction cup, which comprises:

a second suction portion, which comprises a second landing surface, which comprises a second concave outer surface; and a second stem portion, such that an outer end of the second stem portion is connected to an inner end of the second suction portion;

such that an inner end of the second stem portion is connected to a second end of the target central body, such that the first end of the target central body faces away from the second target suction cup;

wherein the first target suction cup is configured to detachably attach to a mounting structure;

wherein outer diameters of each of the first suction portion and the second suction portion are in a range of 40 to 80 mm; and wherein a first outer diameter of the first suction portion is at least 20% larger than a second outer diameter of the second suction portion;

whereby the target piece is positionable on the mounting structure in a first orientation for advanced players with a smaller exposed landing surface of the second suction portion when the first suction portion is attached to the mounting structure; and in a second orientation for beginner players with a larger exposed landing surface of the second suction portion when the second suction portion is attached to the mounting structure; and whereby the at least one throwing member is configured to enable a user to throw the at least one throwing member at the target piece from a distance, such that either the first throwing suction cup or the second throwing suction cup attaches to a surface area of the mounting structure adjacent to the target piece.

2. The suction dart target game system of claim 1, wherein the at least one throwing member does not comprise any suction cup other than the first throwing suction cup and the second throwing suction cup.

3. The suction dart target game system of claim 1, wherein the target central body is configured as a plate, which includes a flat outer surface, which is perpendicular to an elongated axis of the target piece.

4. The suction dart target game system of claim 3, wherein a surface area size of the flat outer surface of the target central body is larger than a surface area size of an outer surface of an attaching suction cup of the at least one throwing member, such that the attaching suction cup is configured to attach to the flat outer surface of the target central body, such that the at least one throwing member is capable of landing on the target piece when the target piece is attached to the mounting structure.

5. The suction dart target game system of claim 1, wherein the target central body is configured as a plate, such that main opposing surfaces of the target central body are parallel to an elongated axis of the target piece.

6. The suction dart target game system of claim 1, wherein the target central body is elongated and rotationally symmetrical around an elongated axis of the target piece.

7. The suction dart target game system of claim 1, wherein outer diameters of each of the first suction portion and the second suction portion are identical and in a range of 40 to 80 mm.

8. The suction dart target game system of claim 1, wherein each of the first concave outer surface and the second concave outer surface of the target piece are configured with a corresponding center depth in a range of 6-12 mm.

9. The suction dart target game system of claim 1, wherein each of the first target suction cup and the second target suction cup are made from a resilient material, which is configured with a shore durometer type a hardness in a range of 52-58.

10. The suction dart target game system of claim 9, wherein stem lengths of corresponding stem portions from corresponding ends of the target central body to center points of corresponding concave outer surfaces of the of the target piece are each in a range of 10-30 mm.

11. The suction dart target game system of claim 1, wherein the at least one throwing member further comprises:

a central protrusion which is configured to protrude from a center portion of the throwing body.

12. The suction dart target game system of claim 11, wherein a weight of the central protrusion is in a range of 35%-43% of a total weight of the at least one throwing member.

13. The suction dart target game system of claim 11, wherein the at least one throwing member further comprises:

a first stem portion, such that an outer end of the first stem portion is connected to an inner end of the first throwing suction cup; and a second stem portion, such that an outer end of the second stem portion is connected to an inner end of the second throwing suction cup;

such that the central protrusion is connected between the first stem portion and the second stem portion.

14. The suction dart target game system of claim 1, wherein the at least one throwing member further comprises:

a first handle portion, which is positioned between an outer end of the first throwing suction cup and a center of the throwing body; and a second handle portion, which is positioned between an outer end of the second throwing suction cup and the center of the throwing body.

15. The suction dart target game system of claim 14, wherein the first handle portion and the second handle portion are each configured with a ribbed surface texture.

16. A suction dart target game method, comprising:

positioning a target piece, wherein a user attaches the target piece to a mounting structure; and throwing a throwing member, wherein the user throws the throwing member towards the target piece from a throwing distance, such that either a first throwing suction cup or a second throwing suction cup of the throwing member attaches to either an exposed target landing surface of the target piece or a surface area of the mounting structure adjacent to the target piece wherein the target piece comprises:

a target central body; and a first target suction cup, such that an inner end of the first target suction cup is connected to a first end of the target central body, such that a second end of the target central body faces away from the first target suction cup, wherein the first target suction cup further comprises:

a first suction portion, which comprises a first landing surface, which comprises a first concave outer surface; and a first stem portion, such that an outer end of the first stem portion is connected to an inner end of the first suction portion;

such that an inner end of the first stem portion is connected to a first end of the target central body, such that a second end of the target central body faces away from the first target suction cup;

a second target suction cup, which comprises:

a second suction portion, which comprises a second landing surface, which comprises a second concave outer surface; and a second stem portion, such that an outer end of the second stem portion is connected to an inner end of the second suction portion;

such that an inner end of the second stem portion is connected to a second end of the target central body, such that the first end of the target central body faces away from the second target suction cup;

wherein the first target suction cup is configured to detachably attach to a mounting structure;

wherein outer diameters of each of the first suction portion and the second suction portion are in a range of 40 to 80 mm; and wherein a first outer diameter of the first suction portion is at least 20% larger than a second outer diameter of the second suction portion;

whereby the target piece is positionable on the mounting structure in a first orientation for advanced players with a smaller exposed landing surface of the second suction portion when the first suction portion is attached to the mounting structure; and in a second orientation for beginner players with a larger exposed landing surface of the second suction portion when the second suction portion is attached to the mounting structure.

17. The suction dart target game method of claim 16, wherein the target piece is positioned on a horizontal surface of the mounting structure.

18. The suction dart target game method of claim 16, further comprising:

measuring a target distance from the throwing member to the target piece, when the throwing member is attached to the surface area of the mounting structure adjacent to the target piece;

such that the target distance is set to zero when the throwing member is attached to the exposed target landing surface.

19. The suction dart target game method of claim 18, wherein the throwing member comprises:

a throwing body;

the first throwing suction cup, which is mounted on a first end of the throwing body, such that an outer end of the first throwing suction cup faces away from the throwing body; and the second throwing suction cup, which is mounted on a second end of the throwing body, such that an outer end of the second throwing suction cup faces away from the throwing body.

20. A suction dart target game system, comprising:

a) at least one throwing member, comprising:

b) a target piece, comprising:

a target central body; and a first target suction cup, such that an inner end of the first target suction cup is connected to a first end of the target central body, such that a second end of the target central body faces away from the first target suction cup, wherein the first target suction cup further comprises:

a first suction portion, which comprises a first landing surface, which comprises a first concave outer surface; and a first stem portion, such that an outer end of the first stem portion is connected to an inner end of the first suction portion;

such that an inner end of the first stem portion is connected to a first end of the target central body, such that a second end of the target central body faces away from the first target suction cup;

a second target suction cup, which comprises:

a second suction portion, which comprises a second landing surface, which comprises a second concave outer surface; and a second stem portion, such that an outer end of the second stem portion is connected to an inner end of the second suction portion;

such that an inner end of the second stem portion is connected to a second end of the target central body, such that the first end of the target central body faces away from the second target suction cup;

wherein the first target suction cup is configured to detachably attach to a mounting structure;

wherein outer diameters of each of the first suction portion and the second suction portion are in a range of 40 to 80 mm; and wherein a first outer diameter of the first suction portion is at least 20% larger than a second outer diameter of the second suction portion;

whereby the target piece is positionable on the mounting structure in a first orientation for advanced players with a smaller exposed landing surface of the second suction portion when the first suction portion is attached to the mounting structure; and in a second orientation for beginner players with a larger exposed landing surface of the second suction portion when the second suction portion is attached to the mounting structure; and whereby the at least one throwing member is configured to enable a user to throw the at least one throwing member at the target piece from a distance, such that the at least one throwing member attaches to a surface area of the mounting structure adjacent to the target piece.

* * * * *